US009177735B2

(12) United States Patent
Mohtasham et al.

(10) Patent No.: US 9,177,735 B2
(45) Date of Patent: Nov. 3, 2015

(54) SAFETY SWITCH WITH DUAL ANTI-TAMPER

(71) Applicant: Idem Safety Switches Limited, Wigan (GB)

(72) Inventors: Medi Mohtasham, Manchester (GB); Hamed Faridfar, Manchester (GB); Vincent Crolla, Warrington (GB); Timothy Jennings, Manchester (GB)

(73) Assignee: Idem Safety Switches Limited, Wigan (GB)

( * ) Notice: Subject to any disclaimer, the term of this patent is extended or adjusted under 35 U.S.C. 154(b) by 256 days.

(21) Appl. No.: 13/852,990

(22) Filed: Mar. 28, 2013

(65) Prior Publication Data

US 2013/0277185 A1 Oct. 24, 2013

(30) Foreign Application Priority Data

Mar. 30, 2012 (GB) ..... 1205751.9

(51) Int. Cl.
*H01H 9/28* (2006.01)
*H01H 27/00* (2006.01)
*H01H 27/06* (2006.01)

(52) U.S. Cl.
CPC ..... *H01H 9/285* (2013.01); *H01H 27/00* (2013.01); *H01H 2027/066* (2013.01)

(58) Field of Classification Search
CPC .. H01H 9/285; H01H 2027/066; H01H 27/00
USPC ..... 200/43.11, 43.04, 43.01, 43.07, 43.16, 200/329, 334, 434
See application file for complete search history.

(56) References Cited

U.S. PATENT DOCUMENTS

| | | | | |
|---|---|---|---|---|
| 5,464,954 | A * | 11/1995 | Kimura et al. | 200/61.62 |
| 5,516,993 | A * | 5/1996 | Wecke et al. | 200/17 R |
| 6,720,508 | B2 * | 4/2004 | Moriyama et al. | 200/200 |
| 7,514,644 | B2 * | 4/2009 | Chen et al. | 200/334 |
| 2007/0080049 | A1 * | 4/2007 | Dimig et al. | 200/61.73 |

FOREIGN PATENT DOCUMENTS

| | | |
|---|---|---|
| DE | 102008032246 A1 | 1/2010 |
| JP | 2001-132291 | 5/2001 |

OTHER PUBLICATIONS

EP Search Report for corresponding EP Application No. EP13161712 (dated Jul. 29, 2013).
Sirius RFID Safety Switches; Configuration Manual-Aug. 2011 (Siemens).
Safety in System: Protection for Man and Machines, 2010/2011, p. 8 (Schmersal).

* cited by examiner

*Primary Examiner* — Edwin A. Leon
(74) *Attorney, Agent, or Firm* — Quarles & Brady LLP; Gavin J. Milczarek-Desai

(57) ABSTRACT

A safety interlock switch with coded interlocking to provide tamper resistance, the coded interlocking having two differently coded technologies 8,10; 16,18. In a preferred embodiment one technology is mechanical in the form of a coded-cam system operated by a coded-tongue 8, the other is electronic comprising a non-contact coded RFID sensor 16,18, and wherein the switch is only enabled when the two different codes have been correctly applied.

13 Claims, 3 Drawing Sheets

SAFETY SWITCH WITH DUAL ANTI-TAMPER

The present invention relates to safety switches and in particular safety interlock switches with an actuator operated cam mechanism.

BACKGROUND OF THE INVENTION

Actuator operated interlock switches require a tongue shaped actuator to be removed and inserted from a main switch housing. The switch is used to enable a power supply to machinery. The switch is generally mounted between a machine guard and a frame for the guard, with the tongue mounted to one of the guard and frame, and the main switch housing attached to the other of the guard and frame. The switch is designed such that the power supply cannot be enabled until the guard is closed and the tongue is thereby inserted in the main switch housing. In a switch with machine guard locking, the tongue cannot be removed from the switch housing and the guard opened until the machine has come to a stop or is in a safe condition for access thereto. In addition to the mechanical aspects of the switch, the switch additionally has several normally closed and normally opened safety contacts, the normally closed contacts enabling power when the guard is closed.

This type of switch has the disadvantage that personnel may override or bypass the safeguard provided by this switch by removing the tongue and inserting a foreign object into the switch to permanently bias it to its normal position where the contacts are closed and power is supplied. This is done to gain easier access to the machine, enabling the guard to be opened without the inconvenience of waiting for the machine to power down.

SUMMARY OF THE INVENTION

An anti-tamper feature has been developed to try and prevent personnel bypassing the safety function of this type of switch. To this end the internal mechanical moving components of the switch actuated by the tongue have a specifically shaped orifice which can be accessed only by a dedicated tongue having a complementary shape. However, this type of structure is still prone to mechanical failure, in that the internal mechanism can be broken by force and the safety contacts remain closed. It is also difficult to detect this type of failure, since the switch appears to operate normally, however, the power is not disabled.

It is an object of the present invention to provide an improved safety switch which overcomes or alleviates the above described disadvantages.

In accordance with the present invention, there is provided a safety interlock switch which has coded interlocking to provide tamper resistance, wherein the interlocking includes two differently coded technologies.

In a preferred embodiment, the switch comprises safety means which checks that the two different codes have been correctly applied before enabling a safety output of the switch which provides machine control.

The safety means may check the codes in a specific predetermined sequences, the specific sequence may include determining at least one of predetermined positions and condition of the interlock.

The safety means may check for a fault condition in the switch and prevent activation of the safety output if a fault condition in the switch is detected.

One of the coded technologies may be mechanical and in preferred embodiment use a coded cam system operated by a coded tongue.

The other of the coded technologies may be electronic and may include a non-contact coded RFID sensor. A coded RFID actuator of the sensor may be mounted on the coded tongue or may be adapted to be mountable separately thereto.

The safety means may comprise a plurality of contacts which open and close in said predetermined sequences upon activation and deactivation of the switch by the actuators or actuators of the switch.

In accordance with a second aspect of the present invention, there is provided a method of operating a safety interlock switch which includes a coded rotary cam system operated by a coded tongue, the switch being of the positively operated type in which the switch must be positively operated by the cam system in order to switch off the power to attendant machinery, the switch further comprising a second interlock in the form of a non-contact RFID sensor, the method comprising the steps of firstly inserting the coded tongue to rotate the cam, secondly checking the code of RFID sensor when the tongue is part inserted to ensure that the code is correct and enabling power only when both interlocks are correctly coded.

The method may further include the steps of performing a system check to ensure that there are no faults in the locking system before allowing the power to be enabled.

The switch may further include a safety circuit with a plurality of contacts, the method further including only enabling power when all contacts are correctly closed in a specific sequence, the sequence may include at least one of checking the codes and position of actuators.

BRIEF DESCRIPTION OF THE DRAWINGS

By way of example, only a specific embodiment of the invention will now be described with reference to the accompanying drawings, in which:—

DETAILED DESCRIPTION

Figure 1:
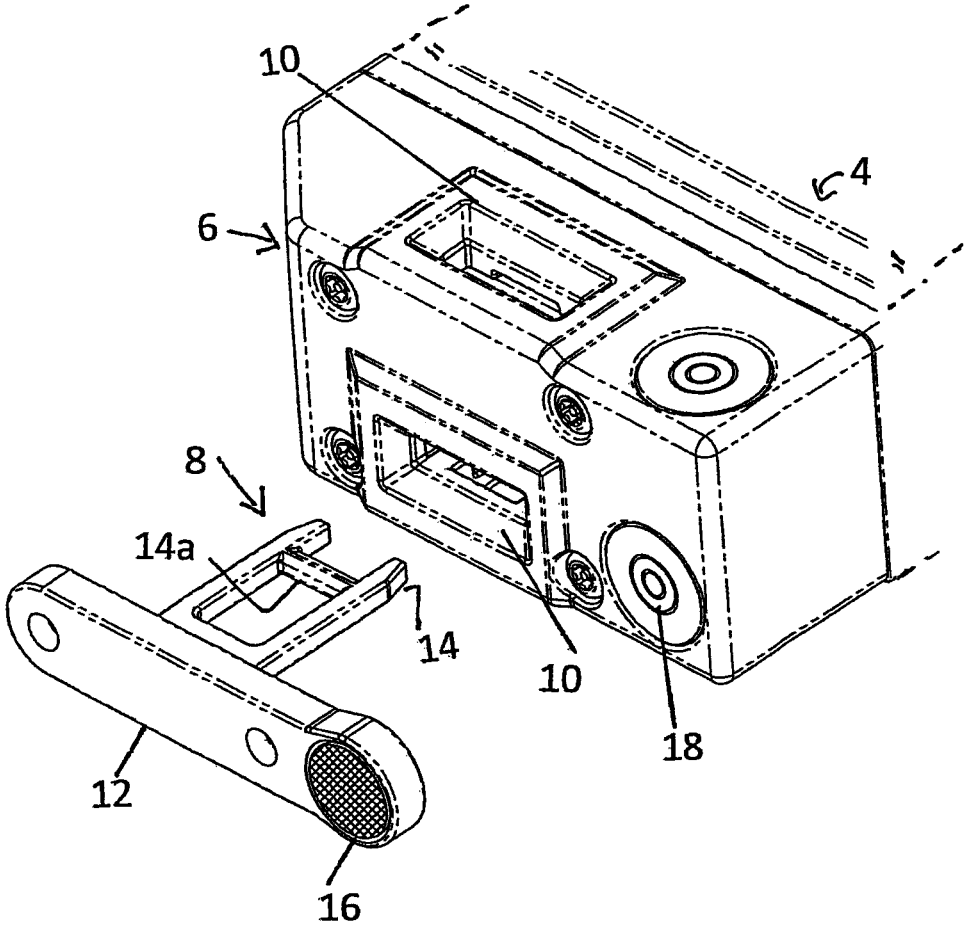
FIG. 1 is a schematic view of a tongue operated safety switch constructed in accordance with a first embodiment of the present invention.

The safety switch, as illustrated in FIG. 1, comprises a switch housing 4 and a cam mechanism 6 operably connected thereto, which cam mechanism 6 is operated by insertion and removal of a mechanical actuator in the form of a tongue 8.

The cam mechanism 6 has two insertion openings 10 for selective insertion of the tongue 8. The plurality of insertion openings 10 enables the mounting of the combined switch and cam mechanism at a variety of geometric locations. In use for example, the tongue 8 is mounted to a guard door and the combined switch housing 4 and cam mechanism 6 on the guard's frame, with the tongue 8 located adjacent one of the insertion openings 10 for easy insertion and removal therefrom. Inside the cam mechanism 6 is a rotary cam (not illustrated) which has two engagement grooves and which can align with a respective insertion opening 10 to the cam mechanism 6. The tongue 8 and engagement grooves are coded to match, in this respect the tongue 8 is specifically shaped to fit into the uniquely shaped engagement groove of the rotary cam of the safety switch; like an effective key.

In this particular example, the tongue 8 has a head 12, which in use is fixed to the guard, and a generally H shaped dependent shaft 12. A cross-bar 14*a* of the shaft 12 hooks into the engagement groove when the tongue 8 is inserted into the insertion opening. With further insertion of the tongue 8, the cross-bar 14*a* drives the rotary cam, such that the insertion opening moves away from the insertion opening, thereby locking the tongue 8 therein. In this position the machine may be powered and the guard locked. It is to be understood that the tongue 8 is not limited to this specific shape, other matched profiles are also envisaged.

In addition to the mechanical actuator, in the form of the tongue 8, there is also a RFID (Radio Frequency Identification) non-contact coded sensor 16, 18. The sensor 16, 18 comprises a RFID actuator 16, mounted on the head 12 of the tongue 8 and a RFID antenna mounted on the cam mechanism 6, and located adjacent an insertion opening 10. An antenna 18 is mounted adjacent each insertion opening 10. The actuator 16 and antenna 18 are matched, that is have a unique code and provide a second unique locking mechanism for the safety switch, described further herein under. It is to be understood that the actuator and antenna could be provided the other way round.

The switch 4 is of the positively operated type in which the switch must be positively operated by the cam mechanism 6 in order to cut power supplied to attendant equipment (not illustrated). To this end the switch has a plurality of normally closed contacts which enable power to attendant machinery and which are closed when the tongue 8 is inserted and broken and thereby power disabled when the tongue is removed. To this end rotation of the cam by the tongue enables actuation of an internal solenoid mechanism or the like inside the switch housing. By providing a specifically coded tongue as the mechanical actuator, this reduces the possibility of deliberate attempts to overcome the normal operation of the switch's safety function, by insertion of a non-matched mechanical actuator.

In the present invention the anti-tamper safety function provided by the mechanical coded tongue is further enhanced by the provision of a second interlock, and anti-tamper safety function which is provided by the RFID coded sensor 16, 18. In this respect the interlocking coded-function is achieved by using two different coded technologies. One is electronic (using RFID coding either unique or by series) and one mechanical using the coded cam system operated by a coded key (tongue). It is intended that both coded technologies need to operate and concur to achieve a safety output for machine control. This provides a unique diverse interlock and provides redundancy in the coded actuation, whereby both must be satisfied to enable the machine to be started.

Figure 2:
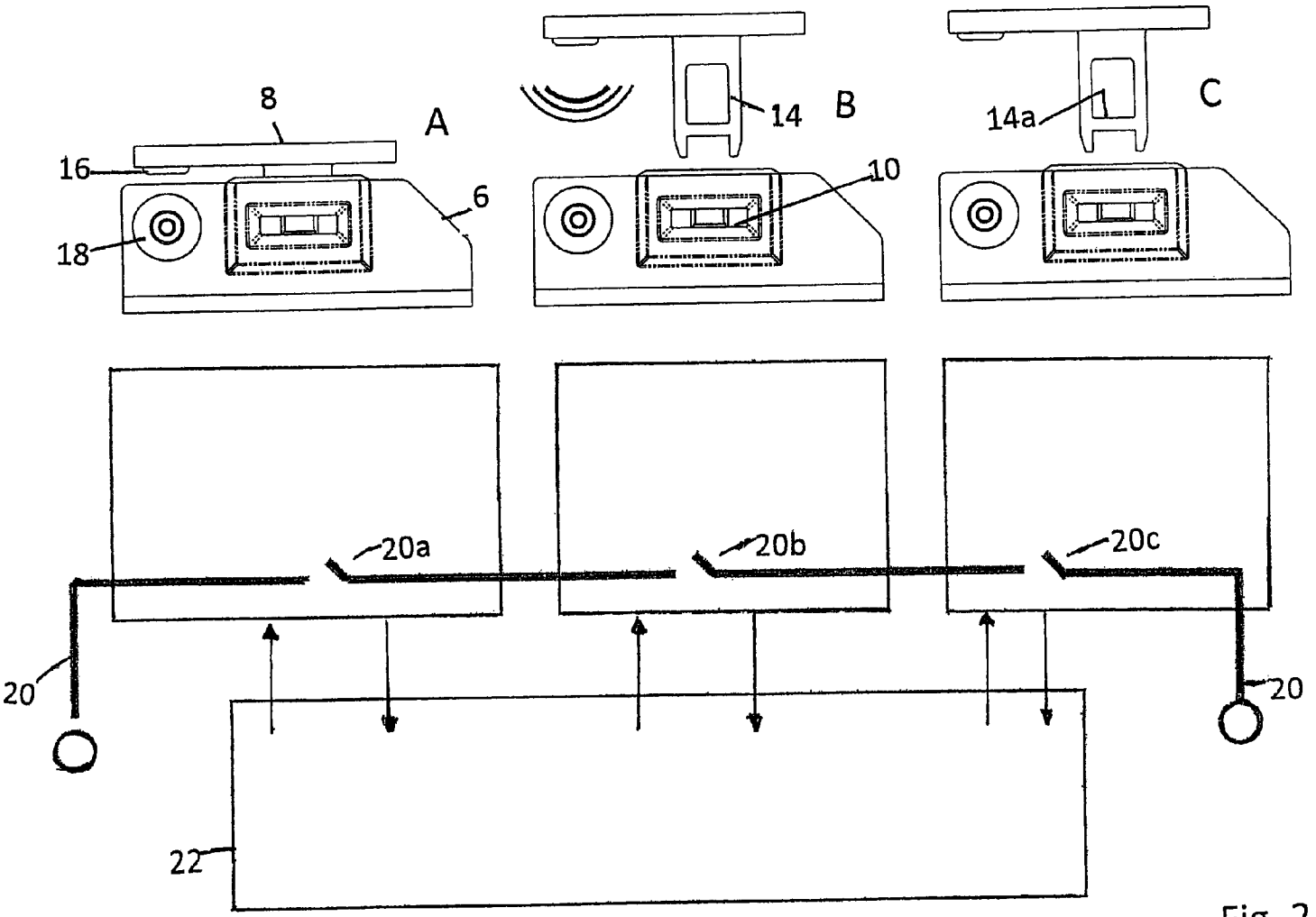
FIG. 2 is a schematic view of the safety circuit used to shown sequence of actuator movement of the safety switch FIG. 1.

As best illustrated in FIG. 2, the switch is provided with a safety circuit 20 which is in communication with a microprocessor 22. The safety circuit 20 is provided with three mechanical contacts 20*a*, 20*b*, 20*c*. The microprocessor 22 monitors the contacts to ensure that a pre-determined sequence of events is followed and also conducts an intelligence check to detect if the lock has been broken by force and the safety contacts remain closed.

The Sequence of events is as follows:

1) RFID sensing check to check the matched code of the sensors 16, 18;
2) A logic check of fault signals from the mechanical contacts 20*a*, 20*b*, 20*c*; and
3) To provide a signal to operate relay 1 (described further herein under) and to enable the machine to be powered.

Safety contact 20*a* provides a mechanical contact from the locking mechanism (position A of FIG. 2) and is closed when:

1) Actuator (the tongue is fully inserted); and
2) Locking mechanism thereof is engaged.

Safety contact 20*b* (position B of FIG. 2) provides an internal relay 1, which is closed when:

1) Actuator is part inserted;
2) RFID code of the sensor is confirmed correct by the microprocessor; and
3) Confirmed by microprocessor 22 that no logic errors exist between contacts 20*a*, 20*b*, 20*c*.

Safety contact 20*c* (position C of FIG. 2) is a mechanical contact from coded anti-tamper tongue operated cam system, and is closed when:

1) The actuator is part insert.

The operating sequence is as follows:

1) Insertion of actuator and contact operation: (normal)

| | |
|---|---|
| Contact 20c | closes FIRST by a set position with actuator |
| Contact 20b | Closes SECOND by a set position with actuator and when RFID code confirmed correct by microprocessor. |
| Contact 20a | Closes THIRD by a set position with actuator and when mechanical actuator is locked. |

2) Withdrawal of actuator and contact operation: (normal)

| | |
|---|---|
| Contact 20a | Opens FIRST by energisation of the switch's solenoid to open its normally closed contacts and with release of the locking mechanism. |
| Contact 20b and 20c | Both open LATER by set position with actuator and when RFID sensing is lost. |

3) Withdrawal of actuator and contact operation—(Fault Condition):

| | |
|---|---|
| Contact 20a | Stays closed after energisation of the switch solenoid due to forced damage or other mechanical fault. |
| Contact 20c | Stays closed after withdrawal of actuator due to forced damage or other mechanical fault. |
| Contact 20b | Opens LATER by set position with actuator and when RFID sensing is lost. Microprocessor Logs Fault and prevents the machine being started even when the actuator is re-inserted. |

By this means the microprocessor 22 is adapted to prevent operation of the machine until a predetermined position and sequence check of the contacts is found to be normal. This enables detection of a broken locking.

The tongue 8 and sensor 16, 18 provide a combined actuator 8, 16, 18. As best illustrated in FIG. 2 when the actuator is inserted into the cam mechanism 6, the RFID code is checked to ensure it is the correct, or matched code for that switch, at a first pre-determined set position (distance) before the mechanical cam system can operate at a second position and achieve closing of the mechanical contacts and locking of the actuator.

This enables the RFID code to be accepted as matching before the final mechanical safety contacts close 20*b* and the machine is able to be started.

When the actuator is withdrawn (after energisation of the switch solenoid to release the lock and open the mechanical contacts), the mechanical contacts are opened before the RFID coded check is disengaged. This is via a predetermined set position (distance) set by the design of the actuator 8, 16, 18 and its position relative to the switch housing 4, 6. This allows for an intelligence check by the internal microprocessor 22 to detect if the lock has been broken by force and the safety contacts remain closed. If the lock has been wrenched (broken) the sequence check of the mechanical contacts 20*a*, 20*b*, 20*c* opening relative to the RFID circuits opening will allow the machine to stop, but will not be able to be restarted even if the actuator 8, 16, 18 is inserted into the broken lock.

In a normal operation condition when the actuator is withdrawn the mechanical cam contact 20*a* opens and the RFID contact 20*b* opens. In an abnormal operating condition when the mechanism has been broken, the actuator is withdrawn, the mechanical contacts 20*a* stay closed, the RFID sensing is stopped and the abnormal condition of the contacts is detected.

In the above described first embodiment, the profiled tongue 8 (key) which provides the cam operated mechanical coding and the RFID key (non contact coded key tag) are assembled in the same mounting and with this alignment of the tongue 8 automatically leads to alignment of the RFID coded key 16, 18. The design and choice of components is selected to ensure that the RFID coded key 16, 18 is always correctly checked before the coded tongue 8 can reach the desired position to cause final operation of the mechanical interlock and the machine started. Not only does this guard against mechanical failure as described above, but also provides a second layer of anti-tamper protection in that only a specifically matched RFID coded key will actuate the mechanism.

Figure 3:
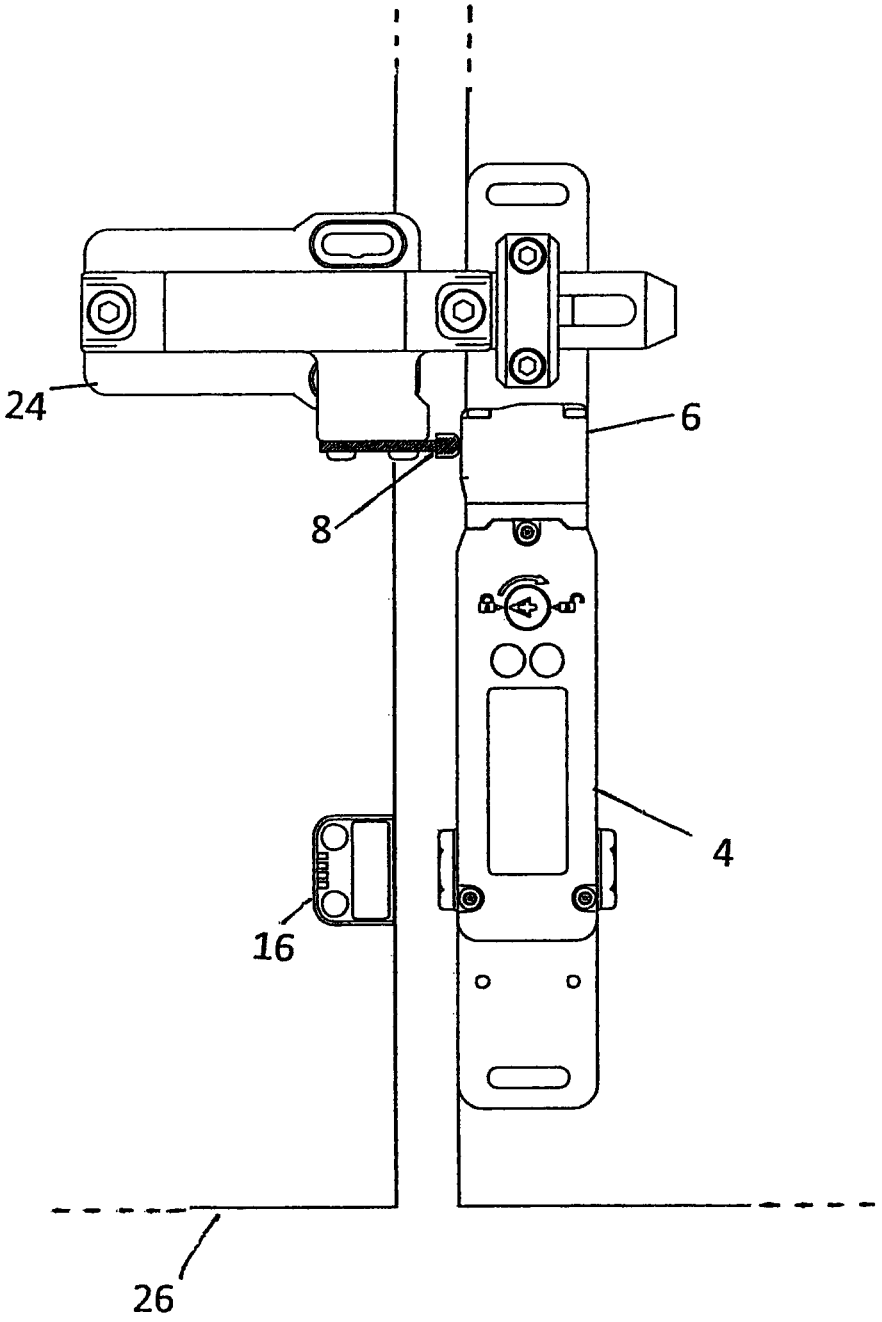
FIG. 3 is a schematic view showing a second embodiment of tongue operated safety switch in situ on a guard and its frame with a separately mounted RFID coded sensor.

Whilst the combined mounting of the two differently coded technologies has been described, it is to be understood that these could also be mounted separately to the guard as best illustrated in FIG. 3. Here, the tongue 8 is mounted on a fixing bracket 24 to the guard door 26 for insertion and removal into the cam mechanism 6 of the switch housing 4. Whilst the non-contact coded RFID actuator 16 is mounted separately thereto on the guard 26. This additionally provides mechanical redundancy on the moving part of the guard door 26, in that two independent fixings would have to fail or be bypassed to create a dangerous situation. Furthermore, this enables the non-contact RFID sensor 16, 18 to be located in a hard to reach location, further preventing tampering. The sequence of opening and closing of the contacts is monitored as per the first embodiment.

It is to be understood that whilst a predetermined set distance has been described for detection of position of actuator and sensor, these could be adapted to be adjusted in situ to account for mounting position. Furthermore, a degree of tolerance may be incorporated to account for minor movement between the positions of guard and frame overtime due to wear and vibration.

The invention claimed is:

1. A safety interlock switch which has coded interlocking to provide tamper resistance, characterised in that the coded interlocking includes two differently coded technologies, wherein one of the coded technologies is mechanical, using a coded cam system operated by a coded tongue, and the other of the coded technologies is electronic, including a non-contact coded RFID sensor, and wherein the switch comprises safety means which checks that the two different codes have been correctly applied before enabling a safety output of the switch which provides machine control.

2. A safety interlock switch according to claim 1, wherein the safety means checks the codes in a specific predetermined sequence.

3. A safety interlock switch according to claim 1, wherein the safety means checks the codes in a specific predetermined sequence, the specific sequence including determining at least one of predetermined position and condition of the interlock.

4. A safety interlock switch according to claim 1, wherein the safety means checks for a fault condition in the switch and prevents activation of the safety output if a fault condition in the switch is detected.

5. A safety interlock switch according to claim 1, wherein the coded RFID actuator of the sensor is mounted on the coded tongue.

6. A safety interlock switch according to claim 1, wherein the coded RFID actuator of the sensor is adapted to be mounted separately to the coded tongue.

7. A safety interlock switch according to claim 1, wherein the safety means comprises a plurality of contacts which open and close in said predetermined sequences upon activation and deactivation of the switch by actuators of the coded interlocking of the switch.

8. A method of operating a safety interlock switch which includes a coded rotary cam system operated by a coded tongue, the switch being of the positively operated type in which the switch must be positively operated by the cam system in order to switch off the power to attendant machinery, characterised in that the switch further comprising a second interlock in the form of a non-contact RFID sensor, the method comprising the steps of firstly inserting the coded tongue to rotate the cam, secondly checking the code of RFID sensor when the tongue is part inserted to ensure that the code is correct and enabling power only when both interlocks are correctly coded.

9. A method according to claim 8, further including the step of performing a system check to ensure that there are no faults in the locking system before allowing the power to be enabled.

10. A method according to claim 9, wherein the switch further includes a safety circuit with a plurality of contacts, the method further including only enabling power when all contacts are correctly closed in a specific sequence.

11. A method according to claim 8, wherein the switch further includes a safety circuit with a plurality of contacts, the method further including only enabling power when all contacts are correctly closed in a specific sequence, and wherein the sequence includes at least one of checking the codes and position of actuators of the cam and senor.

12. A method according to claim 8, further including the step of performing a system check to ensure that there are no faults in the locking system before allowing the power to be enabled, and wherein the switch further includes a safety circuit with a plurality of contacts, the method further including only enabling power when all contacts are correctly closed in a specific sequence.

13. A method according to claim 8, further including the step of performing a system check to ensure that there are no faults in the locking system before enabling power to be enabled, and wherein the switch further includes a safety circuit with a plurality of contacts, the method further including only enabling power when all contacts are correctly closed in a specific sequence, the sequence including at least one of checking the codes and position of actuators of the cam and sensor.

* * * * *